United States Patent [19]

Merly

[11] 4,153,965

[45] May 15, 1979

[54] INSTALLATION FOR DE-SLAGGING CASTING LADLES

[75] Inventor: Jean Merly, Le Vesinet, France

[73] Assignee: Bozel Electrometallurgie, Paris, France

[21] Appl. No.: 850,642

[22] Filed: Nov. 11, 1977

[30] Foreign Application Priority Data

Nov. 19, 1976 [FR] France ..... 76 34856

[51] Int. Cl.[2] ..... B22D 43/00; B22D 41/04

[52] U.S. Cl. ..... 15/104.1 C

[58] Field of Search ..... 15/56, 104.1 C; 134/8

[56] References Cited

U.S. PATENT DOCUMENTS

| | | | |
|---|---|---|---|
| 2,911,662 | 10/1959 | Sedgwick | 15/104.1 C |
| 2,931,060 | 4/1960 | Kelly | 15/104.1 C |
| 2,963,725 | 12/1960 | Bredtschneider | 15/104.1 C |
| 3,034,164 | 5/1962 | Spencer | 15/104.1 C |

*Primary Examiner*—Edward L. Roberts

*Attorney, Agent, or Firm*—Oblon, Fisher, Spivak, McClelland & Maier

[57] ABSTRACT

An installation for de-slagging casting ladles having a de-slagging machine comprising means for raising each ladle to be de-slagged and tilting it into an inclined de-slagging position with its opening directed downwards. Once de-slagging has been completed the raising and tilting means is used to restore the ladle to its original position. Means is provided for immobilizing the ladle in the inclined de-slagging position, as is a movable de-slagging arrangement comprising a tool-holder head, and means for rotating this head about an axis coinciding with that of the ladle in the inclined de-slagging position.

7 Claims, 4 Drawing Figures

INSTALLATION FOR DE-SLAGGING CASTING LADLES

BACKGROUND OF THE INVENTION

The present invention relates to an installation for de-slagging casting ladles.

DESCRIPTION OF THE PRIOR ART

It is well known that in certain metallurgical manufacturing processes, in particular those of ferroalloys, the slag which is denser than the actual metal, is concentrated at the bottom of the casting ladles, on leaving the smelting furnace. This slag constitutes solid scoriae which must be removed periodically to prevent the casting ladle from being put out of use quickly. Hitherto, de-slagging of casting ladles was carried out manually with a scaling hammer. This method has serious drawbacks. In fact, the de-slagging operation using a scaling hammer requires a relatively considerable time, for example on the order of two and a half days for large ladles having a capacity of 3,200 liters. Furthermore, when a scaling hammer is used for de-slagging, there is a risk of causing considerable damage to the refractory lining of the ladle which involves frequent repairs to the latter.

As described in U.S. Pat. No. 2,911,662, a machine is already known which is designed for extracting from a ladle, crucible or cylindrical container, compact or spongy materials adhering to the walls, for example a mass of metal which has accumulated in a ladle, by the action of tools carrying out a rotary movement. This machine comprises means for raising the ladle and tilting it through more than 120° in order that the opening of this ladle is directed downwards. In particular, this means comprises a cylindrical enclosure which can be closed and in which the ladle is previously placed. This machine also comprises a tool-holder head which can be set in rotation and engaged in the ladle, once the latter has been raised and tilted, this head being rotated along an axis parallel to the axis of the ladle inclined in this way. This head supports hard tools which cannot be worn out, which work in the metal mass contained in the ladle, in the manner of the tools of a milling machine, for progressively removing hard shavings.

A machine of this type has the drawback that an operation for de-slagging a ladle, containing a mass of cold metal, takes a considerably long period of time, which makes it impossible to obtain a high rate of productivity.

SUMMARY OF THE INVENTION

Accordingly, it is the object of the present invention to obviate these drawbacks by providing an installation having an automatic operation, which is particularly reliable and carries out the de-slagging operation under hot conditions in a very short period of time.

To this end, this installation for de-slagging casting ladles comprising a de-slagging machine with means for picking up each ladle to be de-slagged, raising the latter and tilting it into an inclined de-slagging position such that its opening is directed downwards and for restoring it to its initial position once the de-slagging has been completed, a movable de-slagging arrangement comprising a tool-holder head and means for rotating this head about an axis and means for moving this de-slagging arrangement along the axis of the ladle in the inclined position, in order to engage the tool-holder head which is set in rotation, progressively and axially in the ladle and thus to clean the slag from this ladle, which slag thus falls freely to the outside, through the opening of the ladle and to withdraw the tool-holder head from the ladle after de-slagging of the latter, is characterised in that means provided for raising and tilting the ladle act directly on the latter, by co-operating with external journals provided on each side of the ladle, means are provided for immobilizing the ladle in the upper inclined de-slagging position and the tool-holder head is arranged coaxially with respect to the ladle in the upper inclined de-slagging position and supports, on its periphery, tools which wear out under the action of the hot slag contained in the ladle.

The de-slagging installation according to the invention advantageously makes it possible to remove, during the free period of time between two consecutive casting operations (for example half an hour), the products sticking to the walls and bottom of the ladles, which products are very hard heterogeneous products which are tough and abrasive when cold or relatively soft, but foul the tools when hot, owing to the presence of the liquid metal. On account of the short time available, the products are hot and consequently less tough than when cold, which facilitates the penetration of the tools which are worn out by these products and a consumption of less energy.

When in contact with the hot products, the heat is transmitted to the tools and the end of the latter loses its mechanical characteristics and wears out. The machine operates at a speed such that each tool makes its effect before wear of the latter becomes excessive. Each tool which penetrates the layer of hot slag attacks the latter throughout its entire depth, thus creating a groove. The speed of advance of the tool-holder head in the ladle and the speed of rotation of the latter are such that each tool cuts a helical groove. The number of tools depends on the diameter of the ladle and more generally on the volume of slag to be removed in order that a de-slagging operation takes place without excessive wear of the tools. In this manner, complete removal of the mass of slag takes place by cutting a type of screw-thread with several threads which are virtually joined.

In comparison with a manual de-slagging operation using a scaling hammer, the de-slagging installation according to the invention also has the advantage of reducing the necessary repairs. Whereas, with manual de-slagging using a scaling hammer, it was necessary to provide repairs to the ladle every 30 casting operations, the automatic installation according to the invention makes it possible to carry out this operation only every 100 casting operations. The entire de-slagging operation takes place automatically and is remotely controlled. In all it lasts from three to four minutes, de-slagging proper, during which the tool-holder head cleans the inside of the ladle, lasting only approximately thirty seconds. During this operation, the non-cooled tools which are preferably simple bars of semi-hard steel of square section, are consumed in the operation.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponds parts throughout the several views, and wherein.

DETAILED DESCRIPTION OF THE PREFERRED EMBODIMENTS

Figure 1:
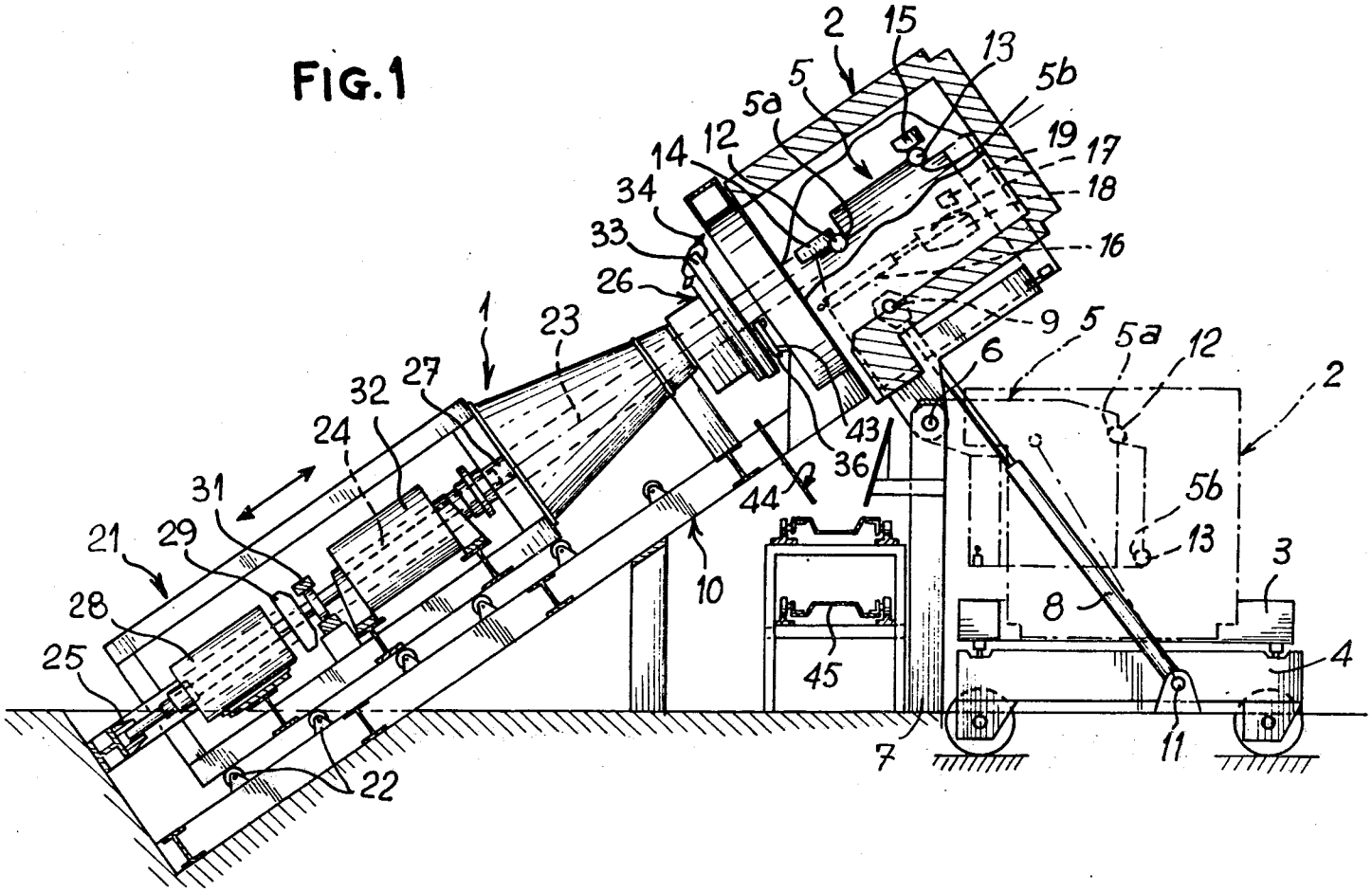
FIG. 1 is a diagrammatic elevational view of a machine for de-slagging casting ladles according to the invention.

Referring now to the drawings the installation for de-slagging casting ladles according to the invention comprises essentially a de-slagging machine 17 which cleans slag from a casting ladle 2, which slag remains inside this ladle after the casting of metal.

In FIG. 1, this ladle 2 is drawn in full line in the inclined position which it occupied during the de-slagging operation. It is also shown in dot-dash line as it is located in the initial position of a de-slagging cycle, on its carriage 3 in turn supported by a transfer carriage 4 forming part of the de-slagging machine 1. The transfer carriage 4 can be moved under the control of a ram which is not shown and its function is to bring the carriage 3 supporting the ladle 2 into a predetermined initial position where the ladle is gripped, then raised to its upper position, whilst being simultaneously tilted so that its opening is directed downwards.

The means provided for this purpose comprise essentially a tilting device 5 constituted by two parallel vertical plates, between which the ladle 2 is placed in the initial position. The tilting device 5 is pivoted about a horizontal pivot 6 supported by pillars 7. The pivotal movement of the arrangement of the tilting device 5 about the horizontal pivot 6 is controlled by a pair of hydraulic rams 8 whose rods are respectively pivoted about pivots 9 on the two vertical plates of the tilting device 5 and the bodies of which are pivoted about fixed pivots 11.

On its front edge, i.e. its edge located on the right-hand side in the initial position of FIG. 1, each vertical plate of the tilting device 5 respectively comprises two notches, namely an upper notch 5*a* and a lower notch 5*b* in which are housed upper and lower journals 12 and 13 respectively, integral with the side wall of the ladle 2, on each side of the latter. As can be seen in FIG. 1, these journals 12 and 13 are simply engaged in the respective notches 5*a* and 5*b*, in the initial position of the ladle. When the ladle 2 is in the upper and inclined position, where it is ready for de-slagging, the journals 12 and 13, which are still housed in their respective notches 5*a* and 5*b* are pressed against respective abutments 14 and 15 supported by the frame 10 of the machine.

To ensure immobilization of the ladle 2 in this inclined deslagging position, there is provided on each side, a locking ram 16 whose rod is integral with a wedge 17 able to slide on a support 18 supported by the frame 10 of the machine and the inclined ramp of which is able to act on an abutment 19 provided outside each plate constituting the tilting arrangement 5.

Each abutment 19 supported by the tilting arrangement 5 is located between the fixed abutment 15 and the journal 13 on the one hand and the stationary support 18 supported by the frame 10, in order to transmit to the journal 13 and the stationary abutment 15, the force exerted by the wedge 17, when the latter is driven in between the support 18 and the abutment 19, as will be seen hereafter, in order to ensure immobilization of the ladle 2 in the upper inclined position.

The frame 10 of the de-slagging machine 1 is inclined upwards and forms a track for a movable carriage designated generally by the reference numeral 21. This carriage moves on the frame 10, whilst being retained and guided by rollers 22 arranged appropriately and shown diagrammatically in the drawing. The carriage 21 is guided such that its axis 23 coincides with that of the ladle 2 when the latter is in the upper inclined position for the purpose of de-slagging.

The movable carriage 21 may carry out an alternating movement along the axis 23 towards and away from the ladle 2. This movement is controlled by a pair of hydraulic rams 24 arranged laterally on either side of the carriage 21, rams whose bodies are connected to the carriage 21 and whose rods are pivoted, at their ends, on the frame 10, about pivots 25. Mounted at the upper end of the carriage 21 is a tool-holder head 26 which is set in rotation by a longitudinal shaft 27. This shaft is set in rotation by means of an arrangement mounted on the carriage 21 and comprising an electric motor 28, an oil-operated make-and-break 29, an electric brake 31 and a geared speed-reducer 32.

Figure 2:
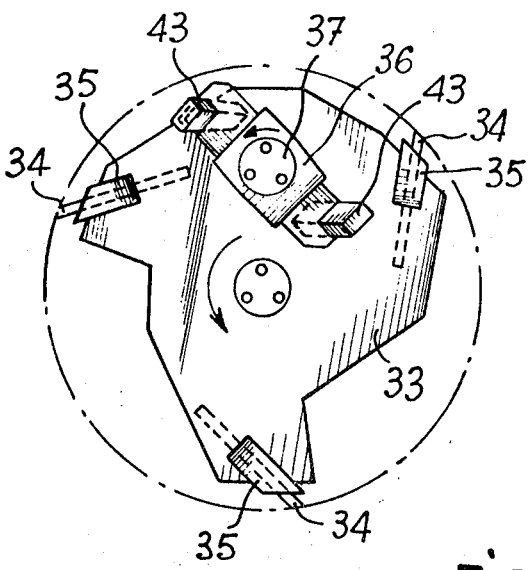
FIG. 2 is a front view of the tool-holder head of the de-slagging machine.
Figure 3:
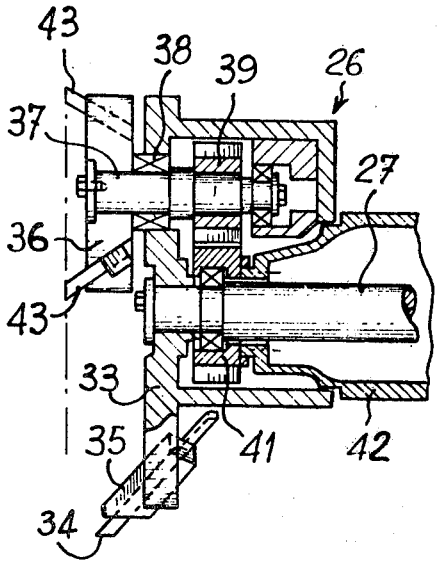
FIG. 3 is an axial cross sectional view of the tool-holder head; and, FIG. 4 is an axial cross sectional view of a barrel for cooling and breaking up the slag.

As shown more clearly in FIGS. 2 and 3, the tool-holder head 26 comprises a transverse plate 33 connected to the end of the drive shaft 27 and supporting, on its periphery, tools 34 distributed uniformly about the axis of rotation and for example three in number. These tools, which are not cooled, are used up during the de-slagging operation which takes place under warm conditions, as will be seen hereafter. They are preferably constituted by simple bars of semi-hard steel and of rectangular cross sections. The tools 34 are locked in the respective tool-holders 35 by quick-action locking devices, comprising a screw or wedge. The tools 34 are not located radially but they are inclined in the direction of rotation.

Mounted on the plate 33 is a planet-wheel carrier 36 integral with a shaft 37 mounted to rotate eccentrically with respect to the shaft 27. This shaft 37 is supported by a bearing 38 and it is integral with a pinion 39 meshing with a pinion 41 fixed to the casing 42 of the tool-holder head 26. Consequently, when the plate 33 rotates, the pinion 39 rolls on the stationary pinion 41 and owing to the provision of this epicyclic gear train, the planet-wheel carrier 36 rotates about itself. This planet-wheel carrier comprises two tools 43 which project towards the front of the planet-wheel carrier 36 as can be seen in FIG. 3 and the ends of which are located in a transverse plane offset towards the front with respect to the transverse plane in which the ends of the tools 34 supported by the plate 33 are located.

The de-slagging installation according to the invention also comprises, below the opening of the ladle 2 in the upper inclined position, a chute 44 for receiving slag, this chute opening out above a discharge conveyor 45 constituted by a succession of cast iron buckets moving on a track by means of rollers.

The operation of the de-slagging installation according to the invention will now be described.

As shown previously, the ladle 2 to be de-slagged and which is supported by its carriage 3, is placed, together with the latter, on the transfer carriage 4. This transfer carriage 4 is then brought into the initial position shown in FIG. 1, by actuating a ram causing the movement of the carriage 4. At this time, the ladle 2 is engaged between the two vertical plates constituting the tilting arrangement 5, its upper and lower journals 12 and 13 respectively thus being housed in the respective notches 5*a* and 5*b* of the two vertical plates of the tilting arrangement 5.

The hydraulic rams 8 are then actuated from the bottom in order to extend their rods. These rams thus control the pivoting of the tilting arrangement 5 about the pivot 6, in counter-clockwise direction, through an angle of approximately 120°. The ladle 2 is entrained in this tilting movement and is returned until it reaches its de-slagging position in which it is inclined downwards. When the ladle 2 arrives in this position, its jurnals 12 and 13 come into contact with the respective fixed abutments 14 and 15. Once the ladle 2 is located in the inclined de-slagging position, it is immobilized on the frame 10 by actuating the two locking rams 16. Each wedge 17 is thus pushed, by sliding on the associated support 18, towards the abutment 19 and it engages between the latter. On account of the inclined ramp comprised by the wedge 17, the force due to the thrust of the ram 16 becomes a transverse force applied to the abutment 19 and transmitted to the journal 13 which is pressed firmly against the fixed abutment 15.

Once the locking operation is terminated, the machine operator starts the electric motor 28 which sets the tool-holder head 26 in rotation. He then controls the forwards movement of the movable carriage 21 manually, towards the ladle 2. This forwards movement takes place by actuating the two lateral rams 24 whose bodies are connected to the carriage 21. The latter thus moves by ascending the track provided on the frame 10, in the direction of the ladle 2. Since the axis of rotation of the tool-holder head 26 coincides with the axis of the ladle 2 in the upper inclined position, this head engages progressively and coaxially in the ladle 2. The planet-wheel carrier 36 whose tools 43 are located at the front, attacks the crust formed on the surface of the slag in the bottom of the ladle. Furthermore, the tools 34 supported by the plate 33 break the glowing slag on the inner lateral surface of the ladle 2. The slag removed in this way falls by gravity into the chute 44 and is then discharged by the conveyor 45.

Once the de-slagging operation has been completed, the operator controls the return of the movable carriage 21 to its lower initial position, in which the tool-holder head 26 is disengaged completely from the ladle 2. Once this position has been reached, he causes unlocking of the ladle 2 by actuating the ram 16 in the reverse direction, then pivoting of the tilting arrangement 5 and ladle 2 in clockwise direction about the pivot 6, in order to return the ladle to the initial position on the carriage 3. This operation takes place by actuating the two hydraulic rams 8 at the nose.

It remains only to discharge the ladle from which slag has been removed, by moving the transfer carriage to its initial position.

Figure 4:
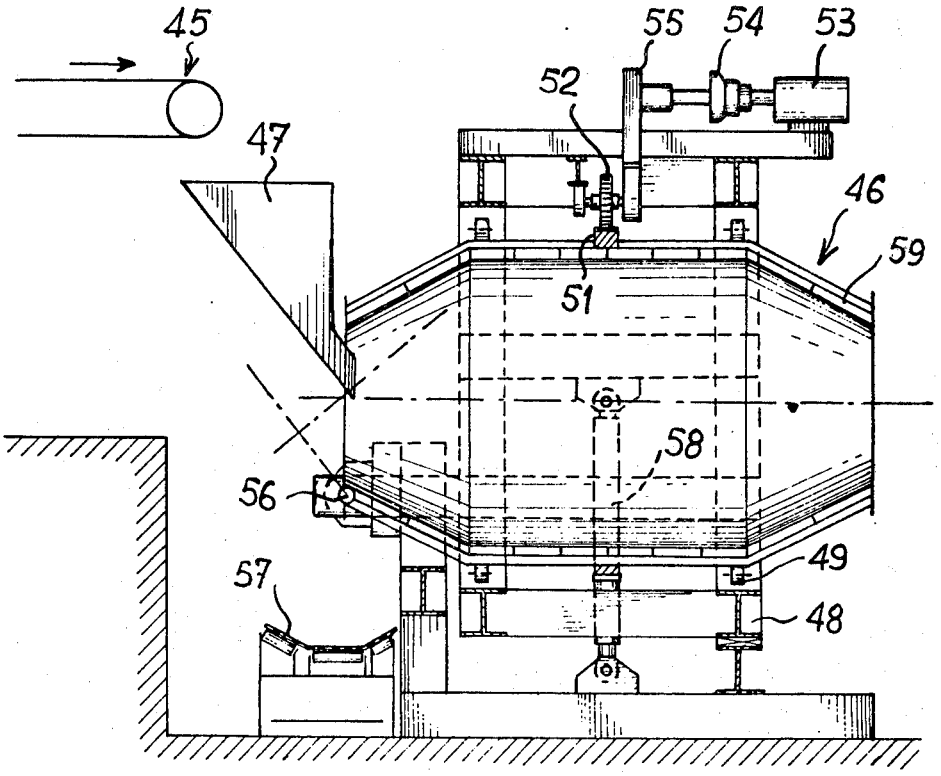

According to an additional feature of the invention, the de-slagging installation comprises a barrel for cooling and breaking up the slag as illustrated in FIG. 4. This barrel 46 is located under the discharge end of the conveyor 45 for removing slag. This conveyor discharges the slag into a chute 47 opening inside the barrel 46. The latter, of cylindrical/conical shape, is mounted to rotate in a cradle 48, by means of rollers 49. In its central part, the barrel 46 comprises a circular rack 51 with which a toothed wheel 52 meshes. This toothed wheel is set in rotation by means of an arrangement comprising an electric motor 53, a make-and-break 54 and a speed-reducer 55. This arrangement is mounted on the upper part of the cradle.

The arrangement of the barrel 46 and its cradle 48 is mounted to pivot about a horizontal pivot 56 located above a conveyor 57 provided for the discharge of the slag which has been broken up and cooled. The tilting movement of the barrel 46 about the pivot 56 is caused by a pair of hydraulic rams 58 pivoted firstly on the cradle 48 and secondly at a fixed point.

The barrel 46 is provided internally with a lining 59 of refractory material and is constructed with a rough surface in order to break up the slag during rotation of the barrel.

In this manner, the slag supplied by the conveyor 45, is introduced into the barrel 48 in which it remains for a certain period of time, of the order of 30 to 45 minutes, during which it is mixed and broken up whilst being cooled.

At the end of this period of time, the barrel is tilted about the pivot 56 in order to cause the cooled broken slag to drop onto the conveyor 57. Obviously, numerous modifications and variations of the present invention are possible in light of the above teachings. It is therefore to be understood that within the scope of the appended claims, the invention may be practiced otherwise than as specifically described herein. What is claimed as new and desired to be secured by Letters Patent of the United States is:

1. An installation for de-slagging casting ladles comprising a de-slagging machine including means for raising each ladle to be de-slagged, tilting it into an inclined deslagging attitude with its opening directed downwards, and after de-slagging, restoring it to its original attitude; a movable de-slagging arrangement including a tool-holder head and means for rotating the head about an axis; means for moving the de-slagging arrangement along the axis of the ladle when in the inclined attitude to engage the rotatable tool-holder head progressively and axially with the slag in the ladle to clean the slag from the ladle, which slag thus falls freely to the outside through the opening in the ladle and to withdraw the tool-holder head from the ladle after de-slagging, the installation being characterised by the means for raising and tilting the ladle acting directly on the latter and co-operating with external journals provided on each side of the ladle, means being provided for immobilizing the ladle in the upper inclined de-slagging position, and the tool-holder head being arranged coaxially with respect to the ladle in the upper inclined de-slagging position and having, on its periphery, tools which wear out under the action of the hot slag in the ladle.

2. An installation for de-slagging casting ladles comprising a deslagging machine including means for raising each ladle to be de-slagged, tilting it into an inclined de-slagging attitude with its opening directed downwards, and after de-slagging, restoring it to its original attitude; a movable de-slagging arrangement including a tool-holder head and means for rotating the head about an axis; means for moving the de-slagging arrangement along the axis of the ladle when in the inclined attitude to engage the rotatable tool-holder head progressively and axially with the slag in the ladle to clean the slag from the ladle, which slag thus falls freely to the outside through the opening in the ladle and to withdraw the tool-holder head from the ladle after de-slagging, the installation being characterized by the means for raising and tilting the ladle acting directly on the latter and co-operating with external journals provided on each side of the ladle, means being provided for immobilizing the ladle in the upper inclined de-slagging position, and the toolholder head being arranged coaxially with respect to the ladle in the upper inclined de-slagging position and having, on its periphery, tools which wear out under the action of the hot slag in the ladle; wherein the means for raising the ladle into the inclined position comprises a tilting arrangement pivoted about a horizontal pivot and comprising two vertical plates to which actuating rams are connected, each of the plates having two notches on its front vertical edge, namely an upper notch and a lower notch, in which are respectively housed the external journals of the ladle, when the ladle is engaged between the two plates of the tilting arrangement by a supporting transfer carriage.

3. An installation according to claim 2, in which the means for immobilizing the ladle in the inclined de-slagging position comprises, on each side of the ladle, two fixed abutments against which bear the upper and lower journals of the ladle housed in respective notches of the plates of the tilting arrangement, and a locking ram whose piston rod is integral with a wedge sliding on a support integral with the frame and engaging between this support and an abutment provided on the adjacent plate of the tilting arrangement, this abutment being located between the fixed abutment against which the lower journal of the ladle bears and the support, in order to exert a force on said journal by means of the wedge engaged between the abutment and the support tending to press the journal against the fixed abutment.

4. An installation according to claim 1 comprising: under the opening in the ladle, in the inclined de-slagging position, a conveyor for discharging slag leaving the ladle during de-slagging; and, a barrel in proximity to said conveyor such that said conveyor through the intermediary of a chute introduces the slag into said barrel for breaking up and cooling the slag.

5. An installation for de-slagging casting ladles comprising a deslagging machine including means for raising each ladle to be de-slagged, tilting it into an inclined de-slagging attitude with its opening directed downwards, and after de-slagging, restoring it to its original attitude; a movable de-slagging arrangement including a tool-holder head and means for rotating the head about an axis; means for moving the de-slagging arrangement along the axis of the ladle when in the inclined attitude to engage the rotatable toolholder head progressively and axially with the slag in the ladle to clean the slag from the ladle, which slag thus falls freely to the outside through the opening in the ladle and to withdraw the tool-holder head from the ladle after de-slagging, the installation being characterized by the means for raising and tilting the ladle acting directly on the latter and co-operating with external journals provided on each side of the ladle, means being provided for immobilizing the ladle in the upper inclined de-slagging position, and the tool-holder head being arranged coaxially with respect to the laddle in the upper inclined de-slagging position and having, on its periphery, tools which wear out under the action of the hot slag in the ladle; wherein th toolholder head comprises a transverse plate integral with a drive shaft and mounted on the periphery of which the tools retained by tool-holders, and a planet-wheel carrier supporting further tools, the ends of which are located forwards of the ends of the first-mentioned tools supported by the plate, the planet-wheel carrier being integral with an eccentric shaft mounted to rotate in the plate and connected to a pinion in mesh with a fixed pinion, coaxial with the drive shaft in order to form an epicyclic gear train and thus to rotate the planet-wheel carrier about its axis.

6. An installation for de-slagging casting ladles comprising a deslagging machine including means for raising each ladle to be de-slagged, tilting it into an inclined de-slagging attitude with its opening directed downwards, and after de-slagging, restoring it to its original attitude; a movable de-slagging arrangement including a tool-holder head and means for rotating the head about an axis; means for moving the de-slagging arrangement along the axis of the ladle when in the inclined attitude to engage the rotatable tool-holder head progressively and axially with the slag in the ladle to clean the slag from the ladle, which slag thus falls freely to the outside through the opening in the ladle and to withdraw the tool-holder head from the ladle after de-slagging, the installation being characterized by the means for raising and tilting the ladle acting directly on the latter and co-operating with external journals provided on each side of the ladle, means being provided for immobilizing the ladle in the upper inclined de-slagging position, and the tool-holder head being arranged coaxially with respect to the ladle in the upper inclined de-slagging position and having, on its periphery, tools which wear out under the action of the hot slag in the ladle; said installation further comprising, under the opening in the ladle, in the inclined de-slagging position, a conveyor for discharging slag leaving the ladle during de-slagging and opening out above a chute for introducing the slag into a barrel for breaking up and cooling the slag, said barrel mounted to rotate about a horizontal axis on a cradle which is pivotal about a horizontal pivot under the control of rams, in order to discharge the cooled broken slag onto a lower conveyor.

7. An installation according to claim 6, in which the barrel is of cylindrical/conical shape, and has internally thereof a refractory lining constructed in order to break up the slag, and externally and in its central part, a transverse rack with which a toothed wheel meshes, which wheel is rotated by an arrangement supported by the cradle and comprising an electric motor, a make-and-break and a speed-reducer.

* * * * *